United States Patent [19]

Hayashi

[11] 4,416,350

[45] Nov. 22, 1983

[54] MUFFLER

[75] Inventor: Yoshimasa Hayashi, Kamakura, Japan

[73] Assignee: Nissan Motor Co., Ltd., Yokohama, Japan

[21] Appl. No.: 387,507

[22] Filed: Jun. 11, 1982

[30] Foreign Application Priority Data

Jun. 26, 1981 [JP] Japan ..... 56/100090

[51] Int. Cl.[3] ..... F01N 1/08

[52] U.S. Cl. ..... 181/272; 181/265; 181/273

[58] Field of Search ..... 181/265–276

[56] References Cited

U.S. PATENT DOCUMENTS

| | | | |
|---|---|---|---|
| 1,402,896 | 1/1922 | Schneebeli | 181/272 |
| 3,469,653 | 9/1969 | Vautros et al. | 181/266 |
| 4,172,508 | 10/1979 | Moss et al. | 181/265 |

*Primary Examiner*—Benjamin R. Fuller

*Attorney, Agent, or Firm*—Schwartz, Jeffery, Schwaab, Mack, Blumenthal & Koch

[57] ABSTRACT

The expansion chamber shell into which the gas from a noise source, such as an internal combustion engine, is rushed is held in an outer shell in a manner to define therebetween a clearance which acts as a sound damping means against the gas passing through the muffler. Thus, the noise caused by the inevitable vibration of the expansion chamber shell is prevented from being directly transmitted to the outside of the muffler.

6 Claims, 3 Drawing Figures

MUFFLER

BACKGROUND OF THE INVENTION

The present invention relates to a muffler, particularly to a muffler for damping the noise of the combustion and exhaust of a combustion engine.

SUMMARY OF THE INVENTION

It is an object of the present invention to provide an improved muffler which can not only damp the combustion and exhaust sounds of the combustion engine, but also damp the noise produced in the muffler.

According to the present invention, there is provided a muffler which comprises an inner shell having therein an expansion chamber; an outer shell covering the inner shell in a manner to define a clearance therebetween, the inner shell being fixed to the outer shell to define a continuous line of contact therebetween thereby to divide the clearance into first and second cavity sections; means connecting the expansion chamber with the first cavity section thereby allowing the first cavity section to show a sound damping effect; a gas inlet pipe leading to the expansion chamber thereby introducing a gas issued from a noise source; and a gas outlet pipe extending from the first cavity section to the open air thereby discharging the gas, fed to the first cavity section from the expansion chamber through the means, into the open air.

BRIEF DESCRIPTION OF THE DRAWINGS

Other objects and advantages of the present invention will become clear from the following description when taken in conjunction with the accompanying drawings, in which.

DESCRIPTION OF A CONVENTIONAL MUFFLER

Figure 1:
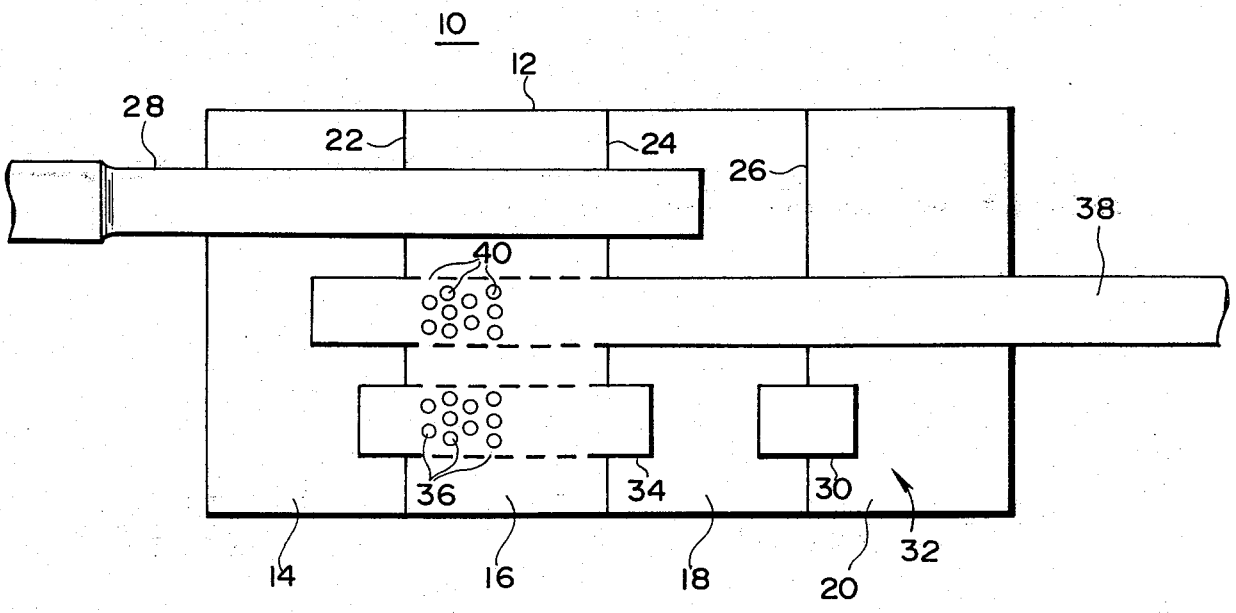
FIG. 1 PRIOR ART
FIG. 1 is a schematic view of a conventional muffler.

Prior to describing the muffler of the present invention, a conventional muffler for an internal combustion engine will be described with reference to FIG. 1 in order to clarify the invention.

The conventional muffler 10 shown comprises generally an outer shell 12 of which interior is divided into four chambers 14, 16, 18 and 20 by three partition walls 22, 24 and 26. An exhaust gas inlet pipe 28 from the exhaust manifold of an internal combustion engine (not shown) leads to the chamber 18, and thus the chamber 18 functions as a first expansion chamber. The first expansion chamber 18 and the chamber 20 are connected through a first communicating pipe 30, and thus the interior of the pipe 30 and the chamber 20 constitute a Helmholtz's resonator 32 which primarily affects low frequency sounds. The first expansion chamber 18 and the chamber 14 are connected through a second communicating pipe 34 which extends across the chamber 16. The pipe 34 is formed with a plurality of small holes 36 through which the interior of the pipe 34 is communicated with the chamber 16. Thus, the chamber 14 functions as a second expansion chamber, while, the chamber 16 functions as a resonance chamber. The second expansion chamber 14 is communicated with an open air through an exhaust gas outlet pipe 38 which extends across the chambers 16, 19 and 20 as shown. The pipe 38 is formed with a plurality of small holes 40 through which the interior of the pipe 38 is communicated with the chamber 16. Thus, the resonance chamber 16 and the holes 40 constitute a resonator which primarily affects high frequency sounds.

However, in practical use, the muffler of the above-mentioned type has a tendency of producing a considerable noise due to its inherent construction. Experiment has revealed that the noise is caused by vibration of the outer shell 12 and that the vibration is mainly caused by the pulsating exhaust gas successively rushed into the first expansion chamber 18 through the gas inlet pipe 28. In fact, the noise generated by the vibrating outer shell 12 is directly transmitted to the open air because of absence of any means which suppresses the vibration of the shell 12. One measure to solve this problem is to increase the thickness of the plate which constitutes the outer shell 12. However, this measure causes a heavier and higher cost construction of the muffler and thus the measure is not practical.

DESCRIPTION OF THE INVENTION

Therefore, it is an essential object of the present invention to provide an improved muffler which is free of the above-mentioned drawbacks.

Figure 2:
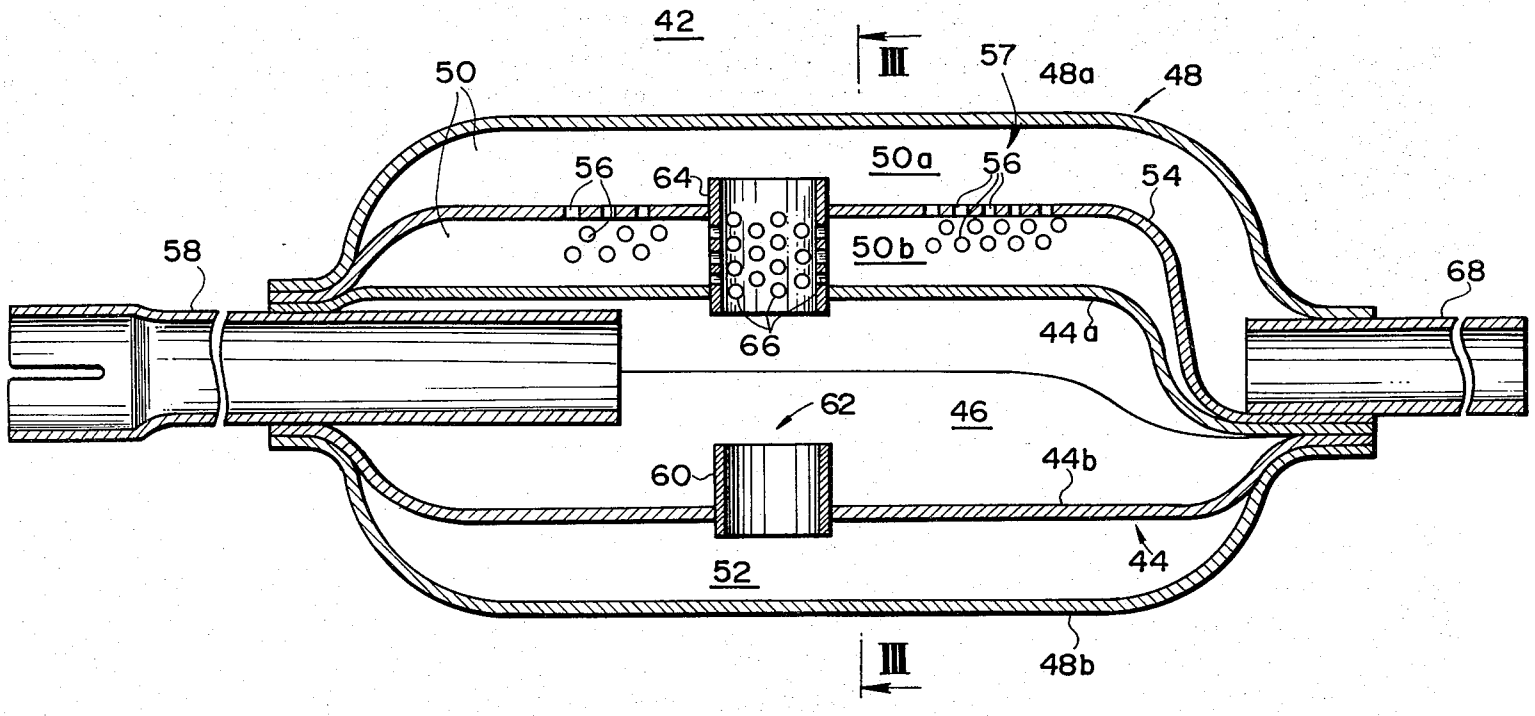
FIG. 2 is a longitudinally sectioned view of an improved muffler according to the present invention.
Figure 3:
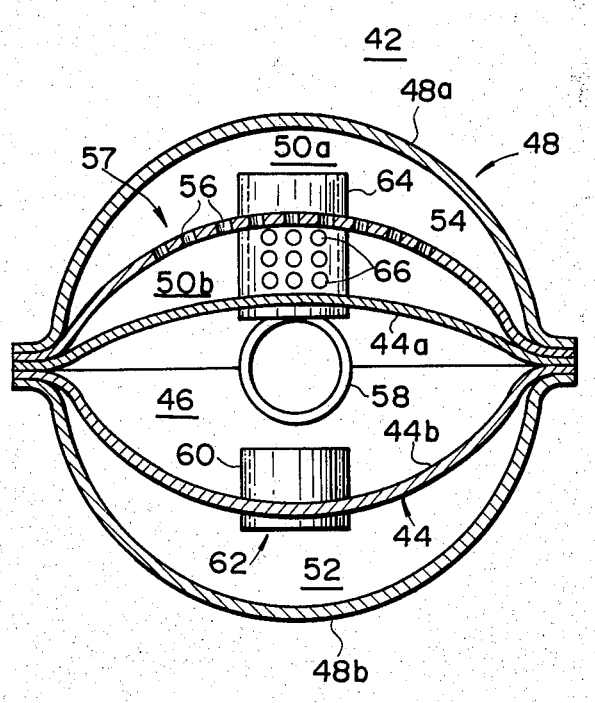
FIG. 3 is a laterally sectioned view taken along the line III—III of FIG. 2.

Referring to FIGS. 2 and 3, there is shown an improved muffler 42 according to the present invention. The muffler 42 comprises an inner shell 44 generally consisting of two dish-shaped plates **44*a* and 44*b* which are coupled to define therebetween a chamber 46. The chamber 46 functions as a first expansion chamber as will become apparent as the description proceeds. The inner shell 44 is held spacedly in an outer shell 48 which generally consists of two dish-shaped plates 48*a* and 48*b*. As is seen from the drawings, each plate has a flange (no numeral) throughout the peripheral portion thereof, and the coupling of the associated plates is made by mating and welding the flanges of the associated plates. Thus, a chamber 50 defined between the inner shell plate 44*a* and the outer shell plate 48*a* and another chamber 52 defined between the inner shell plate 44*b* and the outer shell plate 48*b* are isolated or independent from each other. A dish-shaped partition plate 54 is spacedly disposed in the chamber 50 with the peripheral flange portion thereof entirely welded to the flanges of the coupled plates 44*a* and 48*a*, so that the chamber 50 is divided into two independent chamber sections 50*a* and 50*b*. As will become clear hereinafter, the section 50*a* functions as a second expansion chamber, while, the section 50*b* functions as a resonance chamber. The partition plate 54 is formed with a plurality of small holes 56 through which the two chamber sections 50*a* and 50*b* are communicated. An exhaust gas inlet pipe 58 is fixed to an axial end of the muffler 42 and leads to the first expansion chamber 46 to introduce the exhaust gas from the internal combustion engine to the chamber 46. A first communicating pipe 60 is mounted on the inner shell plate 44*b* to connect the chamber 46 with the chamber 52. Thus, the interior of the pipe 60 and the chamber 52 constitute, as a whole, a Helmholtz's resonator 62. The cross-sectional area S of the pipe 60, the axial length l of the same and the volume V of the chamber 52 are so determined as to damp the sound of a predetermined low frequency level f ($f=C/2\pi\sqrt{S/Vl}$, where, c:sound velocity). A second communicating pipe 64 is supported by the inner shell plate 44***a* and the partition plate 54 and communicates the first expansion chamber 46 with the second expansion chamber 50*a*, as shown. The pipe 64 is formed with a plurality of small holes 66 through which the interior of the pipe 64 and the resonance chamber 50*b* are communicated with each other. Thus, the resonance chamber 50*b* and the holes 56 constitute a resonator 57 which primarily affects high frequency sounds. As is seen from FIG. 2, the first and second communicating pipes 60 and 64 are arranged to be perpendicular to the axis of the exhaust gas inlet pipe 58. Axially extending from the other axial end of the muffler 42 is an exhaust gas outlet pipe 68 which communicates the second expansion chamber 50*a* with the open air.

The exhaust gas from the engine is, first, introduced into the first expansion chamber 46 where the predetermined frequency sounds are reduced to a certain degree. The predetermined low frequency sounds are removed or at least reduced by the Helmholtz's resonator 62 which comprises the chamber 52 and the interior of the first communicating pipe 60. Then, the exhaust gas flows into the second expansion chamber 50*a* where the high frequency sounds are reduced by the resonator 57 which comprises the resonance chamber 50*b* and the holes 56 of the partition wall 54. With this manner, the combustion and exhaust sounds are damped.

In the muffler 42 of the present invention, the following advantageous effect is achieved which is not expected from the above-mentioned conventional muffler.

Similar to the conventional muffler, the pulsating and rushing exhaust gas from the engine forces the inner shell 44 to vibrate at a certain level thereby producing a considerable noise at that portion. However, in the invention, such noise is not directly transmitted to the outside of the muffler 42 because of presence of the chambers 50*a*, 50*b* and 52 which surround the inner shell 44. In fact, these chambers function as noise damper.

As is understood from the foregoing description, in the present invention, the first expansion chamber into which the exhaust gas from the engine is rushed is enclosed by a so-called noise damping means which comprises the chambers 50*a*, 50*b* and 52. Thus, the noise caused by the vibrating inner shell 44 is not directly transmitted to the outside of the muffler 42.

What is claimed is:

1. A muffler comprising:

an inner shell having therein an expansion chamber;

an outer shell covering said inner shell to define a clearance therebetween, said inner shell being fixed to said outer shell to define a continuous line of contact therebetween thereby to divide the clearance into first and second cavity sections;

means connecting said expansion chamber to said first cavity section thereby allowing said first cavity section to show a sound damping effect;

an inlet pipe leading to said expansion chamber thereby introducing thereinto a gas issued from a noise source;

an outlet pipe extending from said first cavity section to the open air thereby discharging the gas, fed to the first cavity section through said means, into the open air.

2. A muffler as claimed in claim 1, further comprising a partition member which is disposed within said first cavity section to divide the same into first and second chambers, said partition member being formed with a plurality of small holes through which said first and second chambers are communicated with each other.

3. A muffler as claimed in claim 2, in which said means is a pipe which extends, across said second chamber, from said expansion chamber to said first chamber from which said outlet pipe extends to the open air, said pipe being formed with a plurality of small holes through which the interior of the pipe is communicated with said second chamber, whereby said first and second chambers act as an expansion chamber and a resonance chamber, respectively.

4. A muffler as claimed in claim 3, further comprising another means which connects said expansion chamber to said second cavity section to allow said second cavity section to act as a resonance chamber.

5. A muffler as claimed in claim 4, in which said another means is another pipe which extends from said expansion chamber to said second cavity section.

6. A muffler as claimed in claim 5, in which said another pipe and said second cavity section are so sized and constructed to form a Helmholtz's resonator.

* * * * *